US011234317B2

(12) United States Patent
Seet et al.

(10) Patent No.: US 11,234,317 B2
(45) Date of Patent: Jan. 25, 2022

(54) MOVING LIGHT PATTERNS CREATION

(71) Applicant: Hewlett-Packard Development Company, L.P., Spring, TX (US)

(72) Inventors: Chim Leng Johann Seet, Singapore (SG); Dustin C. Rosing, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/047,080

(22) PCT Filed: May 15, 2018

(86) PCT No.: PCT/US2018/032746

§ 371 (c)(1),
(2) Date: Oct. 13, 2020

(87) PCT Pub. No.: WO2019/221704

PCT Pub. Date: Nov. 21, 2019

(65) Prior Publication Data

US 2021/0153328 A1 May 20, 2021

(51) Int. Cl.
*H05B 47/155* (2020.01)
*H05B 45/20* (2020.01)
*H05B 45/10* (2020.01)

(52) U.S. Cl.
CPC ..... *H05B 47/155* (2020.01); *H05B 45/10* (2020.01); *H05B 45/20* (2020.01)

(58) Field of Classification Search
None
See application file for complete search history.

(56) References Cited

U.S. PATENT DOCUMENTS

| | | | | |
|---|---|---|---|---|
| 6,676,284 | B1 | 1/2004 | Willson | |
| 7,317,457 | B2 | 1/2008 | Felt | |
| 7,427,167 | B2 | 9/2008 | Holder et al. | |
| 8,134,558 | B1 | 3/2012 | Mayhew | |
| 2005/0151729 | A1 | 7/2005 | Akimoto et al. | |
| 2008/0140231 | A1* | 6/2008 | Blackwell | H05B 47/155 700/90 |

(Continued)

FOREIGN PATENT DOCUMENTS

| | | | |
|---|---|---|---|
| JP | 63164566 | A | 7/1988 |
| WO | WO-2010090130 | A1 | 8/2010 |

*Primary Examiner* — Crystal L Hammond
(74) *Attorney, Agent, or Firm* — HP Inc. Patent Department

(57) ABSTRACT

Examples of creating moving light patterns in a light pipe having a plurality of Light Emitting Diodes (LEDs) are described. In an example, a plurality of keyframes is obtained. The plurality of keyframes define the moving light pattern. Each keyframe is indicative of red-greenblue (RGB) illumination values of each LED 5 from the plurality of LEDs. Further, a linear interpolation is performed, at run-time, between two keyframes of the plurality of keyframes to obtain a plurality of interpolated frames. Each interpolated frame is indicative of interpolated RGB illumination values of each LED. Based on the RGB illumination values of 10 the plurality of keyframes and interpolated RGB illumination values of the plurality of interpolated frames, the plurality of LEDs is illuminated, to create the moving light pattern.

16 Claims, 7 Drawing Sheets

(56) References Cited

U.S. PATENT DOCUMENTS

| | | | | |
|---|---|---|---|---|
| 2015/0123560 | A1* | 5/2015 | Shaffer | H05B 47/18 315/291 |
| 2017/0103697 | A1 | 4/2017 | Kawashima et al. | |
| 2017/0162131 | A1* | 6/2017 | Kimura | G09G 3/3611 |

* cited by examiner

300

302

| LED | 4 | 3 | 2 | 1 | 0 | 1 | 0 | 1 | 0 |
|---|---|---|---|---|---|---|---|---|---|
| KF 1 | 0 | 0 | 0 | 0 | 0 | 0 | B2 | B4 | B2 |
| KF 2 | 0 | 0 | 0 | 0 | B2 | 0 | B2 | B4 | B2 |
| KF 3 | 0 | 0 | 0 | B4 | B2 | 0 | B2 | B4 | B2 |
| KF 4 | 0 | 0 | B4 | B2 | B4 | 0 | B2 | B4 | B2 |
| KF 5 | 0 | B4 | B2 | B4 | 0 | 0 | B2 | B4 | B2 |
| KF 6 | B4 | B2 | B4 | 0 | 0 | 0 | B2 | B4 | B2 |
| KF 7 | B2 | B4 | 0 | 0 | 0 | 0 | B2 | B4 | B2 |
| KF 8 | B4 | B1 | 0 | 0 | 0 | 0 | B2 | B4 | B2 |

304

306

| LED | 4 | 3 | 2 | 1 | 0 | 1 | 0 | 1 | 0 |
|---|---|---|---|---|---|---|---|---|---|
| KF 1 | 0 | 0 | 0 | 0 | 0 | 0 | B2 | B4 | B2 |
| IF 1 | 0 | 0 | 0 | 0 | X1 | 0 | B2 | B4 | B2 |
| IF 2 | 0 | 0 | 0 | 0 | X2 | 0 | B2 | B4 | B2 |
| IF 3 | 0 | 0 | 0 | 0 | X3 | 0 | B2 | B4 | B2 |
| . | | | | | | | | | |
| . | | | | | | | | | |
| . | | | | | | | | | |
| . | | | | | | | | | |
| IF 17 | 0 | 0 | 0 | 0 | X17 | 0 | B2 | B4 | B2 |
| KF 2 | 0 | 0 | 0 | 0 | B2 | 0 | B2 | B4 | B2 |

FIG. 3A

350

| LED | 4 | 3 | 2 | 1 | 0 | 1 | 0 | 1 | 0 |
|---|---|---|---|---|---|---|---|---|---|
| KF 1 | 0 | 0 | 0 | 0 | 0 | 0 | B2 | B4 | B2 |
| KF 2 | 0 | 0 | 0 | 0 | A4 | 0 | B2 | B4 | B2 |
| KF 3 | 0 | 0 | 0 | 0 | 0 | 0 | B2 | B4 | B2 |
| KF 4 | 0 | 0 | 0 | 0 | B2 | 0 | B2 | B4 | B2 |
| KF 5 | 0 | 0 | 0 | B4 | B2 | 0 | B2 | B4 | B2 |
| KF 6 | 0 | 0 | B4 | B2 | B4 | 0 | B2 | B4 | B2 |
| KF 7 | 0 | B4 | B2 | B4 | 0 | 0 | B2 | B4 | B2 |
| KF 8 | B4 | B2 | B4 | 0 | 0 | 0 | B2 | B4 | B2 |
| KF 9 | B2 | B4 | 0 | 0 | 0 | 0 | B2 | B4 | B2 |
| KF 10 | B4 | 0 | 0 | 0 | 0 | 0 | B2 | B4 | B2 |
| KF 11 | 0 | 0 | 0 | 0 | 0 | 0 | B2 | B4 | B2 |

FIG. 3B

MOVING LIGHT PATTERNS CREATION

BACKGROUND

Electronic devices, such as printers, may display light based patterns or animations to indicate operational states of the electronic devices. For example, a specific light pattern may be displayed to indicate a switching ON state, a switching OFF state, an error state, etc., of the electronic devices.

BRIEF DESCRIPTION OF DRAWINGS

The following detailed description references the drawings, wherein:

FIGS. 3A and 3B illustrate a plurality of keyframes for creating moving light patterns, according to various examples;

DETAILED DESCRIPTION

Figure 1:
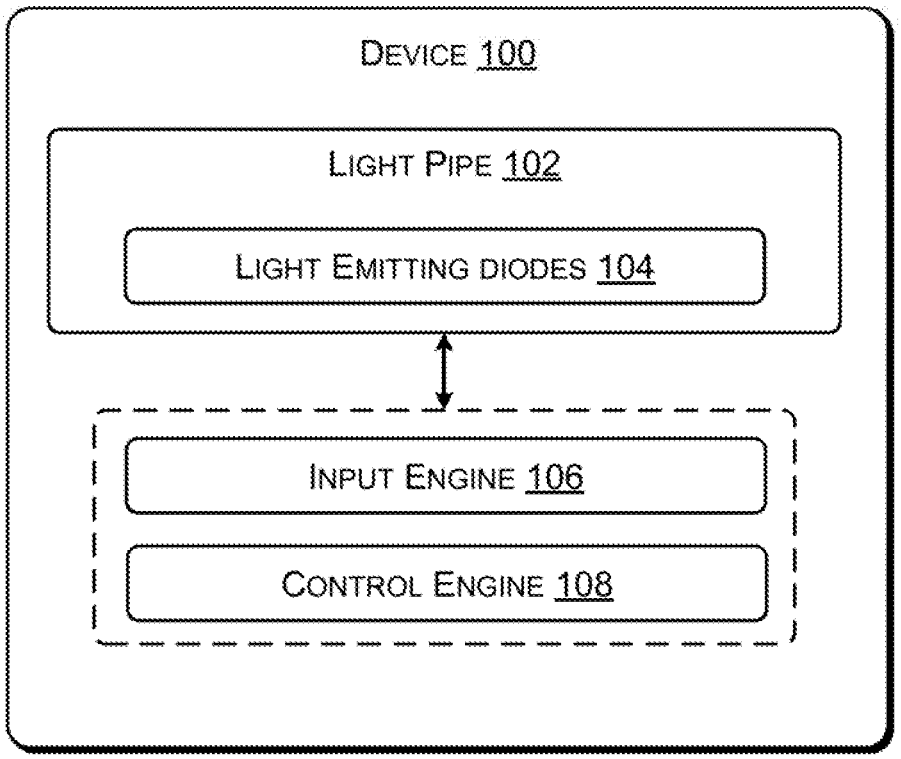
FIG. 1 illustrates a block diagram of a device to create a moving light pattern, according to an example.

To create a moving light pattern, an electronic device may include a plurality of light emitting diodes (LEDs) placed within a light pipe or light diffuser. The moving light pattern is formed by a sequential combination of illumination of the plurality of LEDs in the light pipe. Generally, a brightness of the LEDs varies based on characteristics of the light pipe. Examples of the characteristics of the light pipe include, but are not limited to, thickness of the light pipe, a shape of the light pipe, and a length of the light pipe. Thus, the light pipe attenuates the brightness of the LEDs and to some extent a color of the LEDs. As a result, a user may not be able to perceive effective brightness and color of the LEDs when displayed.

As perceived by the human eye, a sequential combination of illumination of LEDs may be characterized by rapid and/or abrupt illumination and darkening of LEDs. In contrast to rapid or abrupt illumination patterns, there may be a desire to generate a sequential illumination of LEDs characterized by smooth illumination and darkening of LEDs. Taking, by way of illustration, display of a moving light pattern comprising a moving spot may not be perceived as being smooth. This may be due to LED spacing, such as if LEDs are spaced apart from each other. Moving light patterns characterized by rapid and/or abrupt illumination and darkening of LEDs may adversely affect the user experience. In one example, the display of the moving spot may be made smooth, such as by placing LEDs closely to each other. Reducing spacing between LEDs may lead to an increased number of LEDs in the light pipe.

In addition, in embedded systems with light patterns coded in firmware, changes made to firmware code have to be deployed to the electronic device implementing the firmware. As such, modifying light patterns in real-time may present certain challenges. For instance, the electronic device may have to be restarted for changes in light patterns to take effect. However, in some cases restarting the electronic device may not be feasible and may affect the user experience.

The present subject matter describes a method and a device for creating a moving light pattern in a light pipe having a plurality of light emitting diodes (LEDs). The present subject matter provides a smooth moving light pattern with a limited number of LEDs. In addition, the moving light pattern may be modified in real-time, such as without restarting the device.

In an example implementation, the moving light pattern is created by a plurality of keyframes. The term "keyframe" refers to signals and/or states in the form of a data construct that are indicative of a sequence of illumination of the LEDs. Further, each of the plurality of keyframes is associated with a set of color palettes. A color palette is indicative of red-green-blue (RGB) illumination values of an LED. In an example, each color palette of each keyframe is associated with a corresponding LED from the plurality of LEDs. In an example, the plurality of keyframes is defined by a user and is based on characteristics of the light pipe. The plurality of keyframes may be stored, such as in a memory of the device, for later reference.

A plurality of keyframes may be used to create a moving light pattern in alight pipe. Rather than reducing spacing between LEDs, another method for achieving smooth movement of the light pattern may comprise use of a linear interpolation, at run-time, between two keyframes of the plurality of keyframes. The linear interpolation provides a plurality of interpolated frames. The keyframes may represent reference points defining a path of an animation, such as a light pattern. The keyframes are defined by a developer or designer of the animation and are encoded in the firmware. Thus, the keyframes are static in nature, e.g., cannot be changed. The interpolated frames, on the other hand, are generated instantaneously at run-time in between any two keyframes of the animation. The number of interpolated frames between two keyframes is defined by the developer or designer of the animation.

In an example, the linear interpolation is performed at a pre-defined frame rate that may be specified for each moving light pattern. In an example, each interpolated frame from the plurality of interpolated frames corresponds to interpolated RGB illumination values of each LED, in between the two keyframes. The interpolated RGB illumination values are obtained by dividing a difference of the RGB illumination values of a specific LED of the two keyframes by a number of interpolated frames. Thereafter, the RGB illumination value of the particular LED is incremented by the result of the division across the interpolated frames.

Thereafter, based on the RGB illumination values of the plurality of keyframes and interpolated RGB illumination values of the interpolated frames, the plurality of LEDs is illuminated to create the moving light pattern. In an example, illumination of the plurality of LEDs include supplying a pre-defined current to the plurality of LEDs. Values pertaining to the pre-defined current may be stored as a look-up table or set of look-up tables in the electronic device.

In an aspect, a user may modify the RGB illumination values of each LED. The modified RGB illumination values may be stored in a temporary file. When the temporary file is imported in the device, the firmware may access the temporary file to retrieve the RGB illumination values. As a result, the moving light pattern is modified in real-time, without restarting the device and thereby saving cost and time associated with deployment of new firmware when any modification is to be done. Accordingly, the present subject matter enables creation of a smooth moving light pattern, even with a limited number of LEDs. Further, the present subject matter enables in modifying the light pattern in real time.

The present subject matter is further described with reference to the accompanying figures. Wherever possible, the same reference numerals are used in the figures and the following description to refer to the same or similar parts. It should be noted that the description and figures merely illustrate principles of the present subject matter. It is thus understood that various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

The manner in which the systems and the methods for creating a moving light pattern are implemented are explained in detail with respect to FIGS. 1-6. While aspects of described systems and methods for creating a moving light pattern can be implemented in any number of different computing systems, environments, and/or implementations, the examples are described in the context of the following system(s).

FIG. 1 illustrates a block diagram of a device 100 to create a moving light pattern, according to an example. Examples of the device 100 may include, but are not limited to, a printer, an automotive lighting, commercial displays, computer monitors, and televisions. The device 100 includes a light pipe 102 having a plurality of light emitting diodes (LEDs) 104 to create the moving light pattern. A moving light pattern is a sequential combination of illumination of the plurality of LEDs 104 in the light pipe 102. In an example, the light pipe 102 may be made of a plastic material. The light pipe 102 directs all the light therethrough to create an even lighting effect when all LEDs 104 are illuminated.

Further, the device 100 includes an input engine 106 and a control engine 108. The input engine 106 and the control engine 108, amongst other things, include routines, programs, objects, components, and data structures, which, when executed by a processing unit, may perform particular tasks or implement particular abstract data types. The input engine 106 and the control engine 108 may also be implemented as, signal processor(s), state machine(s), logic circuitries, and/or any other device or component that manipulates signals based on operational instructions. Further, the input engine 106 and the control engine 108 can be implemented by hardware, by computer-readable instructions executed by a processing unit, or by a combination thereof.

In an example, the moving light pattern is created from a plurality of keyframes. A keyframe indicates signals and/or states in the form of a data construct that are indicative of a sequence of illumination of the LEDs 104 in the light pipe 102. The input engine 106 may obtain the plurality of keyframes. In an example, the input engine 106 may obtain the keyframes from a memory (not shown) of the device 100. Further, each keyframe is associated with a set of color palettes. Each color palette is indicative of red-green-blue (RGB) illumination values of an LED from the plurality of LEDs 104. In an example implementation, the color palettes may be pre-defined and may be stored in the memory of the device 100. Thus, the input engine 106 may retrieve the set of color palettes associated with each of the plurality of keyframes.

Further, the control engine 108 may obtain a plurality of interpolated frames, at run-time, between two keyframes of the plurality of keyframes. In an example, the control engine 108 may perform a linear interpolation at run-time to obtain the plurality of interpolated frames between the two keyframes. In an example, the plurality of keyframes are fixed or static in nature and for any two keyframes, the linear interpolation is performed to obtain intermediary frames or the interpolated frames. The number of interpolated frames may be pre-defined and the linear interpolation may result in the pre-defined number of interpolated frames in between the two keyframes.

As each keyframe is associated with a combination of RGB illumination values, each of the plurality of interpolated frames has interpolated RGB illumination values associated therewith. In an example implementation, the control engine 108 illuminates the plurality of LEDs 104, based on the RGB illumination values of the plurality of keyframes and the interpolated RGB illumination values of the plurality of interpolated frames, to create the moving light pattern. To illuminate the plurality of LEDs 104, the control engine 108 supplies a pre-defined current to each LED, corresponding to the RGB illumination values of each LED.

Figure 2:
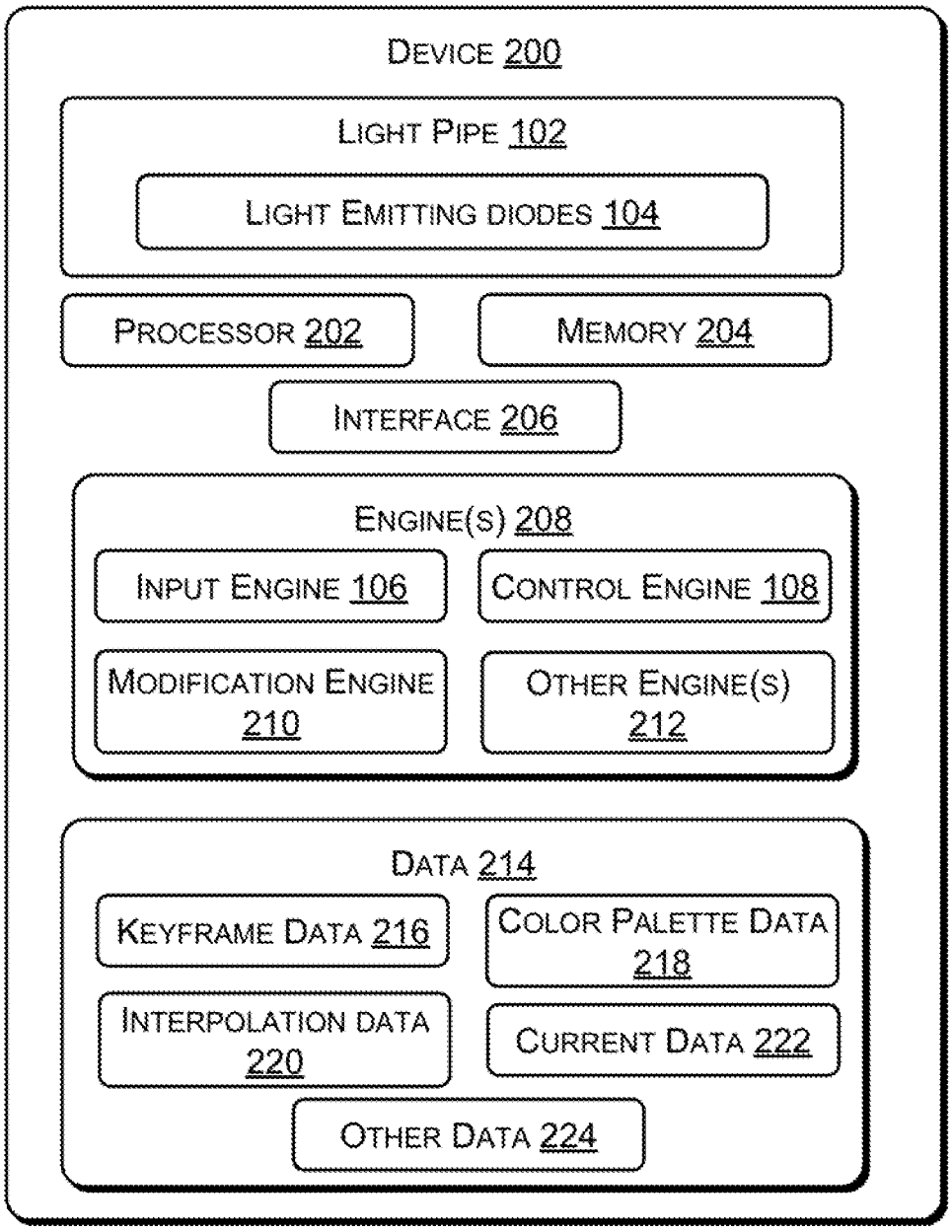
FIG. 2 illustrates a block diagram of a device to create a moving light pattern, according to an example.

The above aspects and further details are described in conjunction with FIG. 2. FIG. 2 illustrates a block diagram of a device 200 to create a moving light pattern, according to an example. In an example, the device 200 may be similar to the device 100. The device 200 thus includes the light pipe 102 having the plurality of LEDs 104.

In one example, the device 200 includes a processor 202 and a memory 204 coupled to the processor 202. The processor 202 may include microprocessors, microcomputers, microcontrollers, digital signal processors, central processing units, state machines, logic circuitries, and/or any other devices that manipulate signals and data based on computer-readable instructions. Further, functions of the various elements shown in the figures, including any functional blocks labeled as "processor(s)", may be provided through the use of dedicated hardware as well as hardware capable of executing computer-readable instructions.

The memory 204, communicatively coupled to the processor 202, can include any non-transitory computer-readable medium known in the art including, for example, volatile memory, such as static random-access memory (SRAM) and dynamic random-access memory (DRAM), and/or non-volatile memory, such as read only memory (ROM), erasable programmable ROM, flash memories, hard disks, optical disks, and magnetic tapes.

The device 200 also includes interface 206. The interface 206 may include a variety of interfaces, for example, interfaces 206 for users. The interface 206 may include data output devices. The interface 206 facilitate the communication of the device 200 with various communication and computing devices and various communication networks, such as networks that use a variety of protocols, for example, Real Time Streaming Protocol (RTSP), Hypertext Transfer Protocol (HTTP), Live Streaming (HLS) and Real-time Transport Protocol (RTP).

Further, the device 200 may include engines 208. The engines 208, amongst other things, include routines, programs, objects, components, and data structures, which perform particular tasks or implement particular abstract data types. The engines 208 may also be implemented as, signal processor(s), state machine(s), logic circuitries, and/ or any other device or component that manipulates signals based on operational instructions. Further, the engines 208 can be implemented by hardware, by computer-readable instructions executed by a processing unit, or by a combination thereof. In one example, the engines 208 include the input engine 106, the control engine 108, a modification engine 210, and other engine(s) 212. The other engine(s) 212 may include programs or coded instructions that supplement the applications or functions performed by the device 200. The engines 208 may be implemented as described in relation to FIGS. 1 and 2.

In an example, the device 200 includes data 214. The data 214 may include a keyframe data 216, a color palette data 218, an interpolation data 220, a current data 222, and other data 224. The other data 224 may include data generated and saved by the engines 208 for implementing various functionalities of the device 200.

The input engine 106 may receive input from a user to define the plurality of keyframes to create the moving light pattern. In an example, the user may create multiple moving light patterns by defining plurality of keyframes for each moving light pattern. The plurality of keyframes are based on the characteristics of the light pipe 102. Examples of the characteristics of the light pipe 102 include, but are not limited to, a thickness of the light pipe 102, a shape of the light pipe 102, and a length of the light pipe 102. In an example, the light pipe 102 includes nine LEDs that may be spaced apart from each other. For example, the LEDs 104 may be placed one inch apart from each other.

To create the moving light pattern, the input engine 106 may obtain the plurality of keyframes. In an example, the plurality of keyframes may be obtained from a user of the device 200 or may be obtained from the keyframe data 216. Each keyframe from the plurality of keyframes is associated with a set of color palettes. A color palette may be indicative of red-green-blue (RGB) illumination values of an LED. The color palettes may be stored in the device 200 as the color palette data 218.

Table 1 below provides some example color palettes and RGB illumination values associated with the color palettes.

TABLE 1

| Palette ID | Red | Green | Blue |
|---|---|---|---|
| O | 0 | 0 | 0 |
| R1 | 255 | 0 | 0 |
| Rn | — | — | — |
| G1 | 0 | 255 | 0 |
| Gn | — | — | — |
| B1 | 0 | 0 | 255 |
| B2 | 96 | 100 | 255 |
| B4 | 0 | 130 | 200 |
| Bn | — | — | — |
| A1 | 240 | 200 | 64 |
| An | — | — | — |

The palette IDs indicate a dominant color for a specific combination of the RGB illumination values. For example, when the color palette has a palette ID 'O', that indicates that the LED associated with that particular color palette is not illuminated. Likewise, palette ID R1 indicates that red color is illuminated for the LED associated with that particular color palette. Palette ID G1 indicates a dominant green color, palette ID B1 indicates a dominant blue color, and palette ID A1 indicates a dominant amber color. Further, the palette IDs R1 to Rn indicate different shades of red color with R1 being the brightest and the Rn being dimmer. The same holds true for G1 to Gn, B1 to Bn, and A1 to An.

In order to display a smooth movement of light from one keyframe to another, the control engine 108 may obtain a plurality of interpolated frames between any two keyframes of the plurality of keyframes. In an example, the control engine 108 may perform a linear interpolation at run-time to obtain the plurality of interpolated frames. Each interpolated frame is indicative of an interpolated RGB illumination value of each LED from the plurality of LEDs. For every light pattern, the number of interpolated frames to be obtained between two keyframes is pre-defined. Further, the control engine 108 may calculate interpolated RGB illumination values for each interpolated frame.

The real-time interpolation while creating the moving light pattern is now explained in conjunction with FIGS. 3A and 38. FIGS. 3A and 3B illustrate a plurality of keyframes 300 and 350 for creating moving light patterns, according to various examples. The plurality of keyframes 300 and 350 are explained with reference to FIGS. 1 and 2. The plurality of keyframes 300 depicts a scenario where a device, such as a printer is searching for a Wi-Fi network. In an example, the input engine 106 may obtain the plurality of keyframes 300 from a user or from a memory. A section 302 of the plurality of keyframes 300 displays a back and forth movement of a spot of blue light while searching for the Wi-Fi network. As the plurality of keyframes 300 is associated with the palette IDs B2 and B4, the back and forth moving pattern of blue light is formed by sequential illumination of the plurality of keyframes 300. As mentioned with respect to Table 1, the palette IDs B2 and B4 indicates a brighter shade and a dimmer shade of blue color.

Keyframe 1 (KF1) indicates that the LEDs (e.g., LEDs 0, 1, 2, 3, and 4 noted across the top of section 302) are not illuminated as palette ID O is associated with the LEDs. Keyframe 2 (KF2) indicates that LED 0 is associated with palette ID B2 and the remaining LEDs are not illuminated as the remaining LEDs are associated with palette ID O. In KF1 and KF2, apart from change in the RGB illumination values of one LED, i.e., LED 0, which moves from no illumination to bright blue color (corresponding to palette ID B2), remaining LEDs have same RGB illumination values. Therefore, linear interpolation is performed in between KF1 and KF2 to show smooth transition of colors between the palette IDs O and B2, at LED 0.

In an example implementation, the control engine 108 may perform the linear interpolation at run-time to obtain a pre-defined number of interpolated frames. Block 304 depicts the various interpolated frames obtained by the control engine 108. In an example, seventeen interpolated frames, 306 i.e., interpolated frame 1 (IF1) to interpolated frame 17 (IF17) are obtained from the linear interpolation between KF1 and KF2. As KF1 and KF2 are associated with RGB illumination values, the control engine 108 may calculate interpolated RGB illumination values X1, X2, X3, . . . , X17 corresponding to each interpolated frame IF1 to IF17, between KF1 and KF2.

In an example, the interpolated RGB illumination values for each interpolated frame may be obtained by dividing a difference of the RGB illumination values of KF1 and KF2 by the number of interpolated frames to obtain an RGB and incrementing a lower RGB illumination value between KF1 and KF2 by the output of the division. In an example, the control engine 108 may store the interpolated RGB illumination values as the interpolation data 220.

Moving back to movement of the blue spot, keyframe 3 (KF3) provides that LED 0 and LED 1 are associated with palette IDs B4 and B2 respectively. As B2 is brighter than B4, when the LEDs 0 and 1 are illuminated as per the illumination values of palette IDs B2 and B4, a blinking movement of the spot is depicted. Further, to show that the spot is moving further, keyframe 4 (KF4) provides that LEDs 0, 1, and 2 are associated with palette IDs B4, B2, and B4 respectively. When the LEDs 0, 1, and 2 are illuminated as per the RGB illumination values of palette ID B2 and B4, a movement of the blue spot is depicted across the LEDs.

In an example implementation, when the keyframes KF1 to keyframe 8 (KF8) have been illuminated and the Wi-Fi network is not detected, the plurality of keyframes 300 may be re-illuminated. In such scenario, the control engine 108 may perform linear interpolation between the last keyframe KF8 and the first keyframe KF1 to display continuously running light pattern.

The keyframes (KF1 to KF8) represent various reference points that define a path of the moving light pattern. The keyframes are encoded in the firmware. Thus, the keyframes are static in nature, e.g., cannot be changed. The interpolated frames (IF1 to IF17), on the other hand, are generated instantaneously at run-time in between any two keyframes of the moving light pattern. The number of interpolated frames between two keyframes is defined by the developer or designer of the moving light pattern.

In an example implementation, there may be scenarios that before the printer gets connected to the Wi-Fi, the Wi-Fi network is lost. As a status of the printer changes from searching for Wi-Fi to Wi-Fi error, the execution of the plurality of keyframes 300 is interrupted and another set of keyframes 350 (see FIG. 3B), depicting another light pattern is executed to indicate an error in connection. In an example, the plurality of keyframes 300 may be interrupted in between before being executed completely, i.e., till KF8. For example, the plurality of keyframes 300 may get interrupted at keyframe 5 (KF5). Accordingly, the control engine 108 may perform linear interpolation between KF5 of the plurality of keyframes 300 to KF2 of the plurality of keyframes 350. Thus, a smooth transition from one light pattern to another light pattern may be depicted. Though the interpolation is explained to be performed between KF5 and KF2 of the plurality of keyframes 300 and 350 respectively, the control engine 108 may perform the linear interpolation between any keyframes of different light patterns.

Referring to FIG. 2, based on the RGB illumination values of the plurality of keyframes and the interpolated RGB illumination values of the plurality of interpolated frames, the control engine 108 may illuminate the LEDs 104. To illuminate the LEDs 104, the control engine 108 may supply a current to each LED associated with the plurality of keyframes and the plurality of interpolated frames. The current applied to the LEDs 104 corresponds to the RGB illumination values of each LED and the interpolated RGB illumination values.

In an example implementation, each of the plurality of LEDs 104 is an 8-bit red-green-blue (RGB) LED. As a result, for each of the RGB color, an LED has an illumination value ranging from 0-255. The 256 illumination values (from 0-255) for each RGB channel may be stored as a look-up table or a set of look-up tables in the device 200 as the current data 222. The current data 222 may be indicative of different values of current to be applied across the RGB channels of the LEDs to achieve the illumination value as per the color palettes associated with each LED. The look-up table(s) provide information about an illumination achieved from the light pipe 102, when a specific current is applied to each RGB channel of the LEDs. Accordingly, for every input, the look-up tables provide an expected output. Thus, the look-up table(s) act as a transfer function of the light pipe 102. Though the present subject matter is described with reference to 8-bit LEDs 104, the LEDs 104 may be 4-bit, 6-bit, and so on.

Therefore, to apply the current, the control engine 108 may select a pre-defined current from the current data 222 and supply the selected current to each LED associated with the plurality of keyframes and the plurality of interpolated frames. Therefore, the current data 222 provides ease in computation of the current values that is to be applied for any RGB illumination value across the LEDs 104.

In an example implementation, the modification engine 210 facilitates in real time modification of the color palettes. For example, the modification engine 210 enables a user to make edits in the RGB illumination values associated with the color palettes of the plurality of color palettes. In an example, the user may access the color palette data 218 through a temporary file partition in the device 200. In an example, the temporary file partition may be accessed by a secure file transfer protocol (sftp).

The user may extract the color palette data 218 by sending an export command to the device 200. The export command includes information about the data that is to be exported from the device 200. Thus, in response to the export command, the modification engine 210 may copy the color palette data 218 in a text file. The text file may be accessible to a user of the device 200, such as a designer of the light patterns. The user may make modifications in the text file. For example, if any RGB illumination value is not providing a desired color during execution of the light pattern, the user may make suitable modifications in the RGB illumination values.

Thereafter, the user may store the modifications in the text file by sending an import command. In response to the import command, the modification engine 210 may store the modified text file in the temporary file partition of the device. When a code of the firmware is executed, the firmware may access the modified text file in the temporary file partition to obtain RGB illumination values of the plurality of keyframes. As a result, the modifications made by the user are applied to a running firmware of the device 200, without restarting the device 200.

In an example implementation, the modification engine 210 may compare the existing light patterns with the modified light patterns to confirm the changes made in the text file. For example, the modification engine 210 supports a toggle command to provide a comparison of the previous light pattern and the modified light pattern. Once it is confirmed that the modified light pattern is finalized, the modified text file is implemented in the firmware.

Figure 4:
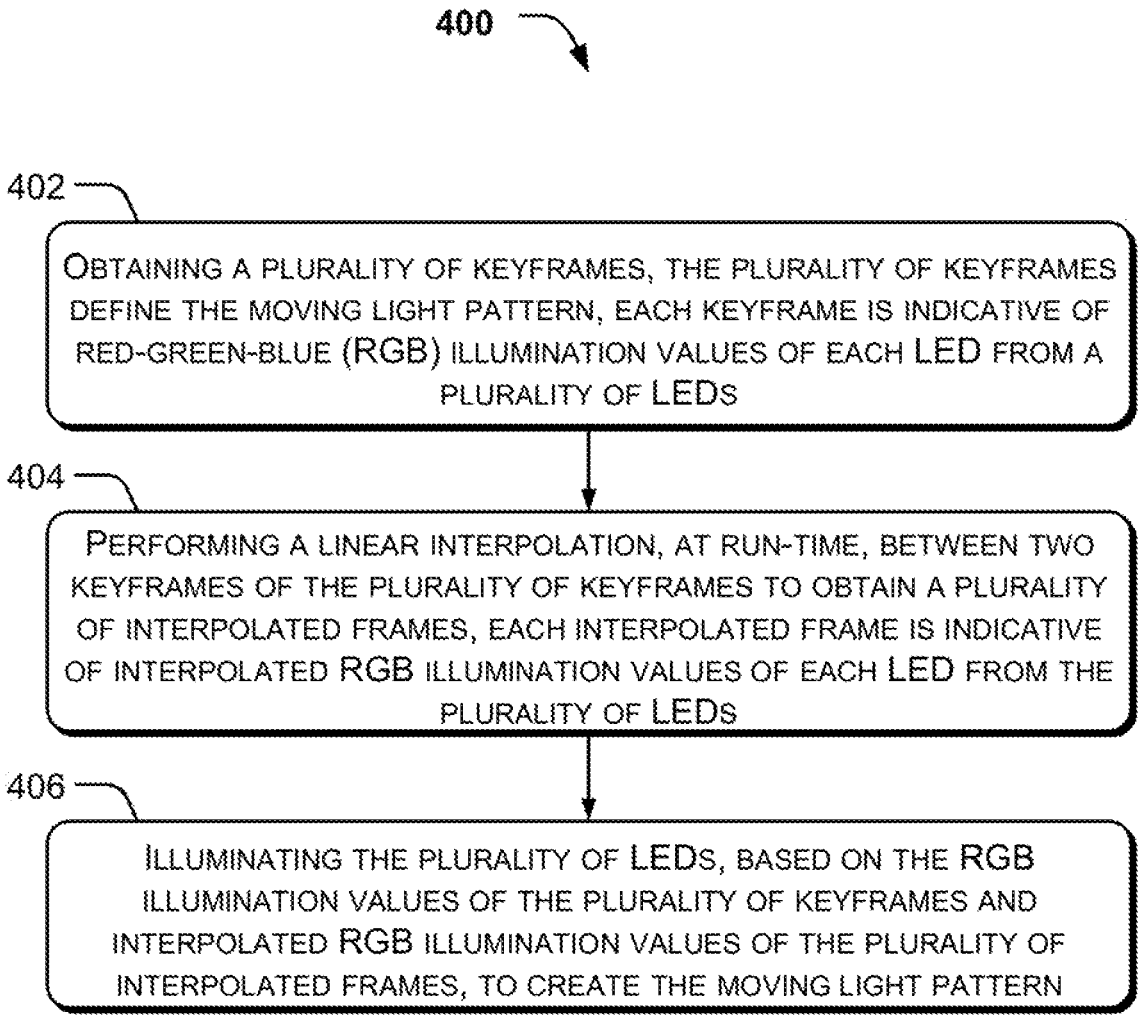
FIG. 4 illustrates a flow chart depicting a method for creating a moving light pattern, according to an example.
Figure 5:
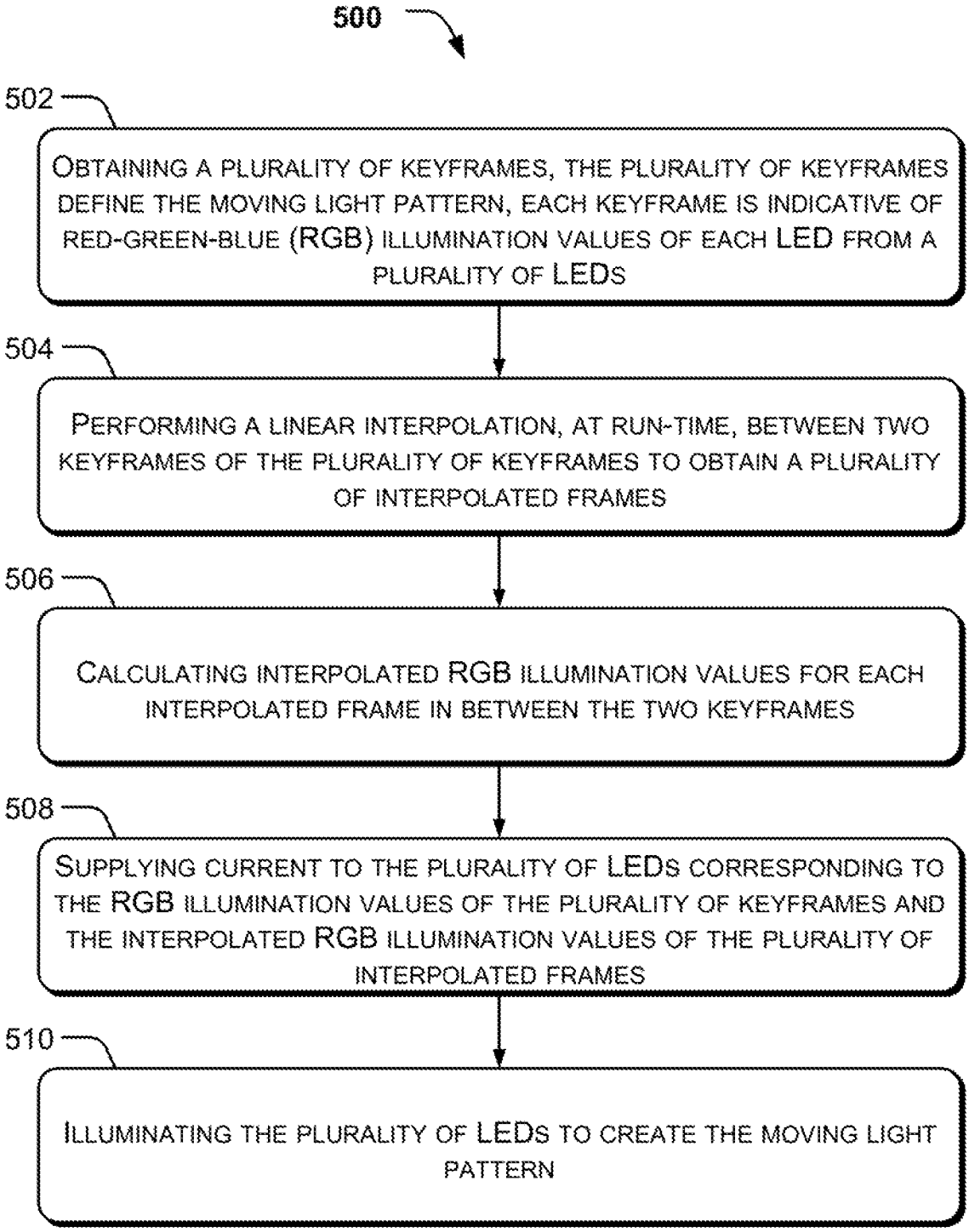
FIG. 5 illustrates a flow chart depicting a method for creating a moving light pattern, according to an example.

FIGS. 4 and 5 illustrate methods 400 and 500 for creating a moving light pattern, according to various examples. The methods 400 and 500 describe creating a moving light pattern in a light pipe having light emitting diodes (LEDs). The methods 400 and 500 can be implemented by processor(s) or device(s) through any suitable hardware, a non-transitory machine readable medium, or a combination thereof. Further, although the methods 400 and 500 are described in context of a device that is similar to the aforementioned device 100, other suitable devices or systems may be used for execution of the methods 400 and 500.

In some example, processes involved in the methods 400 and 500 can be executed based on instructions stored in a non-transitory computer-readable medium. The non-transitory computer-readable medium may include, for example, digital memories, magnetic storage media, such as a magnetic disks and magnetic tapes, hard drives, or optically readable digital data storage media.

Referring to FIG. 4, at block 402, a plurality of keyframes may be obtained. In an example implementation, the plurality of keyframes define a moving light pattern in a light pipe. The term "keyframe" refers to signals and/or states in the form of a data construct that are indicative of a sequence of illumination of the LEDs. In an example implementation, the input engine 106 may obtain the plurality of keyframes. For example, the input engine 106 may obtain the keyframes when a user of the device 100 inputs the plurality of keyframes through an interface of the device 100. In another example, the input engine 106 may retrieve the plurality of keyframes from a memory of the device 100. Further, each keyframe is indicative of red-green-blue (RGB) illumination values of each LED from the LEDs.

At block 404, a linear interpolation is performed, at run-time, between two keyframes of the plurality of keyframes to obtain a plurality of interpolated frames. In an example, the keyframes represent various reference points that define a path of the moving light pattern. The keyframes are encoded in the firmware and thus, are fixed or static in nature. The interpolated frames, on the other hand, are generated instantaneously at run-time between any two keyframes of the moving light pattern. Further, each interpolated frame is indicative of interpolated RGB illumination values of each LED from the LEDs. In an example implementation, the control engine 108 may perform the linear interpolation at real time.

At block 406, the LEDs are illuminated, based on the RGB illumination values of the plurality of keyframes and the interpolated frames, to create the moving light pattern. In an example implementation, the control engine 108 illuminates the LEDs based on the RGB illumination values of the plurality of keyframes and interpolated RGB illumination values of the plurality of interpolated frames.

Referring to FIG. 5, at block 502, a plurality of keyframes may be obtained. The term "keyframe" refers to signals and/or states in the form of a data construct that are indicative of a sequence of illumination of the LEDs. In an example implementation, the input engine 106 may obtain the plurality of keyframes.

In an example implementation, the plurality of keyframes define the moving light pattern. Further, each keyframe is indicative of red-green-blue (RGB) illumination values of each LED from the LEDs. In an example, the RGB illumination values are based on characteristics of the light pipe. The characteristics of the light pipe may include, but are not limited to, a thickness of the light pipe, a shape of the light pipe, and a length of the light pipe.

At block 504, a linear interpolation is performed, at run-time, between two keyframes of the plurality of keyframes to obtain a plurality of interpolated frames. In an example implementation, the control engine 108 may perform the linear interpolation in real time. In an example, a number of interpolated frames may be pre-defined between the two keyframes. For example, a developer may define the number of interpolations to be performed between the two keyframes while developing an animation for the moving light pattern.

In an example, the linear interpolation may be performed between a first keyframe and a last keyframe of the moving light pattern to loop the moving light pattern. In another example, the linear interpolation may be performed between a keyframe of the moving light pattern and a keyframe of another light pattern to indicate a smooth transition from one animation to another animation.

At block 506, interpolated RGB illumination values may be calculated for each of the plurality of interpolated frames in between the two keyframes. In an example implementation, the control engine 108 may calculate the interpolated RGB illumination values for each of the plurality of interpolated frames. The interpolated RGB illumination values are obtained by dividing a difference of the RGB illumination values of a specific LED of the two keyframes by a number of Interpolated frames. Thereafter, the RGB illumination value of the particular LED is incremented by the result of the division across the interpolated frames.

At block 508, current may be supplied to the LEDs corresponding to the RGB illumination values of the plurality of keyframes and the interpolated RGB illumination values of the plurality of interpolated frames. In an example implementation, the control engine 108 may supply the current to the LEDs. In an example, the current to be supplied may be pre-defined and is stored as a look-up table in the device 100. In another example, the current to be supplied may be selected from a set of look-up tables that may be stored in the device 100.

At block 510, the LEDs are illuminated to create the moving light pattern. Based on the current supplied to the LEDs, the LEDs are illuminated to create the moving light pattern.

Figure 6:
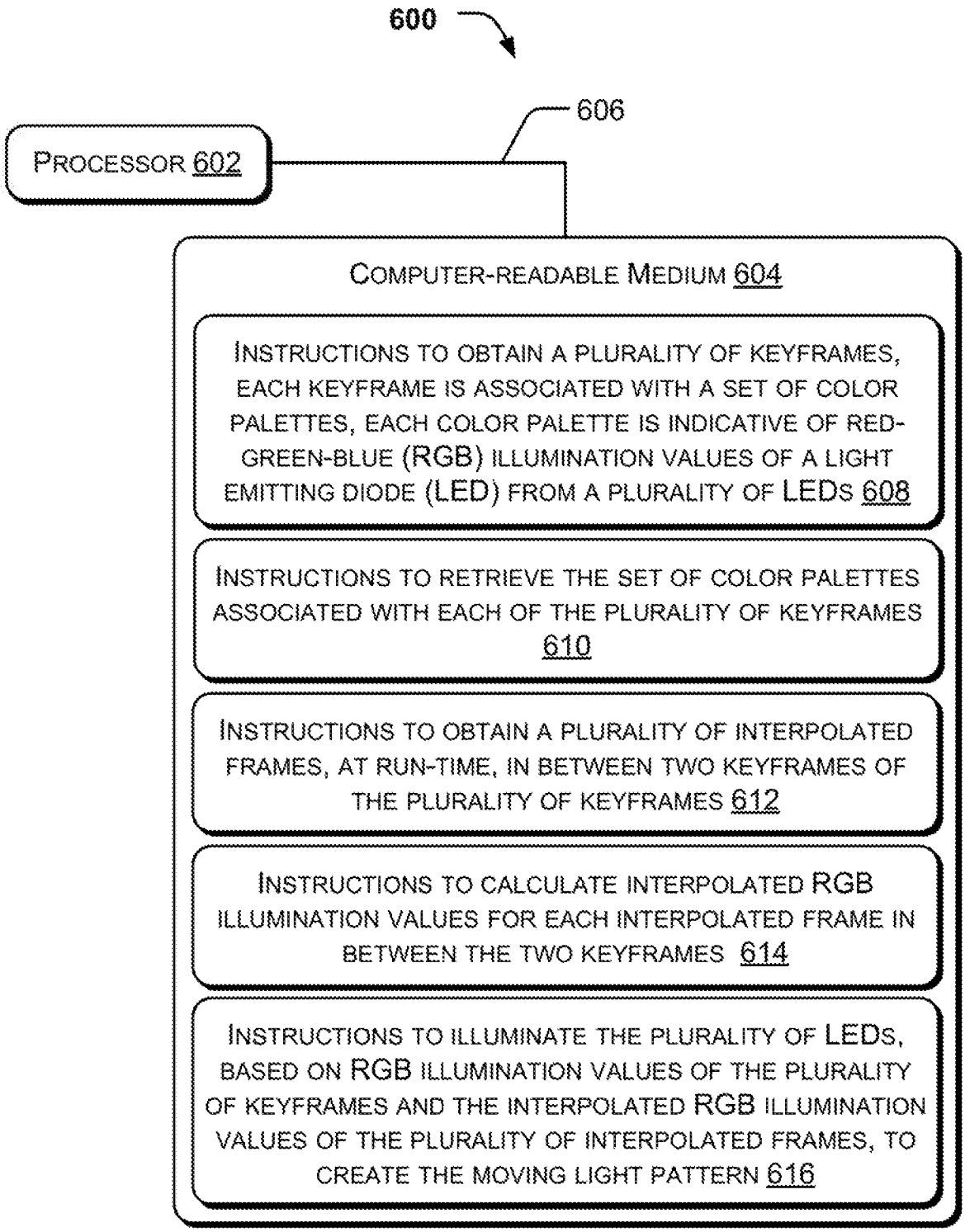
FIG. 6 illustrates a system environment implementing a non-transitory computer readable medium for creating a moving light pattern, according to an example.

FIG. 6 illustrates a system environment 600 implementing a non-transitory computer readable medium for creating a moving light pattern, according to an example. The system environment 600 includes a processor 602 communicatively coupled to the non-transitory computer-readable medium 604 through a communication link 606. In an example, the processor 602 may be a processing resource of a device, such as a printer, for fetching and executing computer-readable instructions from the non-transitory computer-readable medium 604.

The non-transitory computer-readable medium 604 can be, for example, an internal memory device or an external memory device. In an example, the communication link 606 may be a direct communication link, such as any memory read/write interface. In another example, the communication link 606 may be an indirect communication link, such as a network interface. In such a case, the processor 602 can access the non-transitory computer-readable medium 604 through a communication network (not shown).

In an example, the non-transitory computer-readable medium 604 includes a set of computer-readable instructions for creating a moving light pattern in a light pipe. The set of computer-readable instructions may include instructions as explained in conjunction with FIGS. 1 and 2. The set of computer-readable instructions can be accessed by the processor 602 through the communication link 606 and subsequently executed to perform acts for creating the moving light pattern.

Referring to FIG. 6, in an example, the non-transitory computer-readable medium 604 may include instructions 608 to obtain a plurality of keyframes. Each keyframe is associated with a set of color palettes. Each color palette is indicative of red-green-blue (RGB) illumination values of a light emitting diode (LED) from a plurality of LEDs. In an example, the light pipe includes nine LEDs. The non-transitory computer-readable medium 604 may include instructions 610 to retrieve the set of color palettes associated with each of the plurality of keyframes.

Further, the non-transitory computer-readable medium 604 may include instructions 612 to obtain a plurality of interpolated frames, at run-time, in between two keyframes of the plurality of keyframes. In an example implementation, the plurality of interpolated frames is obtained by performing a linear interpolation between the two keyframes of the plurality of keyframes. In an example, the linear interpolation is performed between one of a first keyframe and a last keyframe of the moving light pattern. In another example, the linear interpolation is performed between a keyframe of the moving light pattern and a keyframe of another light pattern. In an example implementation, a number of interpolated frames in the plurality of interpolated frames may be pre-defined based on the two keyframes in between which the interpolation is being performed.

The non-transitory computer-readable medium 604 may include instructions 614 to calculate interpolated RGB illumination values for each interpolated frame in between the two keyframes. In addition, the non-transitory computer-readable medium 604 may include instructions 616 to illuminate the LEDs based on the RGB illumination values of the plurality of keyframes and the interpolated RGB illumination values of the plurality of interpolated frames, to create the moving light pattern. Further, in an example, the instructions to illuminate the plurality of LEDs include selecting a pre-defined current to be applied to each LED corresponding to the RGB illumination values of the plurality of keyframes and the interpolated RGB illumination values of the plurality of interpolated frames.

Although examples for the present disclosure have been described in language specific to structural features and/or methods, it is to be understood that the appended claims are not limited to the specific features or methods described herein. Rather, the specific features and methods are disclosed and explained as examples of the present disclosure.

We claim:

1. A method for creating a moving light pattern in a light pipe, the light pipe comprising a plurality of light emitting diodes (LEDs), the method comprising:

obtaining a plurality of keyframes, including a first keyframe and a second keyframe, the plurality of keyframes define the moving light pattern, wherein each keyframe is indicative of red-green-blue (RGB) illumination values of each LED from the plurality of LEDs, the first keyframe indicative of first RGB illumination values of each LED and the second keyframe indicative of second RGB illumination values of each LED;

performing a linear interpolation, at run-time, between the first keyframe and the second keyframe to obtain a plurality of interpolated frames, wherein each interpolated frame is indicative of interpolated RGB illumination values of each LED from the plurality of LEDs, by, for each LED:

dividing a difference between each second RGB illumination value of the second keyframe and a corresponding first RGB illumination value of the first keyframe by a number of the interpolated frames to determine an incrementation value;

determining each interpolated RGB illumination value of each interpolated frame by successively incrementing between the corresponding first RGB illumination value of the first keyframe and a corresponding second RGB illumination value of the second keyframe by the incrementation value; and illuminating the plurality of LEDs, based on the RGB illumination values of the plurality of keyframes and the interpolated RGB illumination values of the plurality of interpolated frames, to create the moving light pattern.

2. The method as claimed in claim 1, wherein the RGB illumination values are based on characteristics of the light pipe, the characteristics of the light pipe comprising a thickness of the light pipe, a shape of the light pipe, and a length of the light pipe.

3. The method as claimed in claim 1, wherein performing the linear interpolation comprises calculating the interpolated RGB illumination values for each interpolated frame in between the first keyframe and the second keyframe.

4. The method as claimed in claim 3, wherein illuminating the plurality of LEDs comprises supplying current to the plurality of LEDs corresponding to the RGB illumination values of the plurality of keyframes and the plurality of interpolated frames.

5. The method as claimed in claim 1, wherein the second keyframe comprise a last keyframe of the moving light pattern.

6. The method as claimed in claim 1, wherein the first keyframe and the second keyframe comprise a keyframe of the moving light pattern and a keyframe of another light pattern.

7. The method of claim 1, wherein the plurality of interpolated frames comprises a first interpolated frame and one or multiple other interpolated frames, and wherein determining each interpolated RGB illumination value of each interpolated frame by successively incrementing between the corresponding first RGB illumination value of the first keyframe and the corresponding second RGB illumination value of the second keyframe by the incrementation value comprises:

determining each interpolated RGB illumination value of the first interpolated frame by incrementing the corresponding first RGB illumination value of the first keyframe by the incrementation value; and determining each interpolated RGB illumination value of each of the other interpolated frames by incrementing a corresponding interpolated illumination value of an immediately prior keyframe by the incrementation value.

8. A device comprising:

a light pipe having light emitting diodes (LEDs);

an input engine, coupled to the light pipe, to:

obtain a plurality of keyframes, wherein each keyframe is associated with a set of color palettes, each color palette from the set of color palettes being indicative of red-green-blue (RGB) illumination values of an LED from the LEDs;

retrieve the set of color palettes associated with each of the plurality of keyframes, including a first keyframe indicative of first RGB illumination values of each LED and the second keyframe indicative of second RGB illumination values of each LED; and a control engine, coupled to the light pipe, to:

obtain a plurality of interpolated frames, at run-time, between the first keyframe and the second keyframe, wherein each interpolated frame is indicative of interpolated RGB illumination values of each LED from the LEDs, by, for each LED:

dividing a difference between each second RGB illumination value of the second keyframe and a corresponding first RGB illumination value of the first keyframe by a number of the interpolated frames to determine an incrementation value;

determining each interpolated RGB illumination value of each interpolated frame by successively incrementing between the corresponding first RGB illumination value of the first keyframe and a corresponding second RGB illumination value of the second keyframe by the incrementation value; and illuminate the LEDs, based on the RGB illumination values of the plurality of keyframes and the interpolated RGB illumination values of the plurality of interpolated frames, to create a moving light pattern.

9. The device as claimed in claim 8, wherein to obtain the plurality of interpolated frames, the control engine is to perform linear interpolation to calculate the interpolated RGB illumination values for each interpolated frame in between the first keyframe and the second keyframe.

10. The device as claimed in claim 9, wherein to illuminate the LEDs, the control engine is to, select a pre-defined current, to be supplied to each LED associated with the plurality of keyframes and the plurality of interpolated frames, corresponding to the RGB illumination values of each LED.

11. The device as claimed in claim 10, wherein the pre-defined current corresponding to each RGB color is stored as a look-up table accessible by the control engine.

12. The device as claimed in claim 9, wherein the control engine is to, perform the linear interpolation between the first keyframe and a last keyframe of the moving light pattern, as the second keyframe.

13. The device as claimed in claim 9, wherein the control engine is to, perform the linear interpolation between a keyframe of the moving light pattern, as the first keyframe, and a keyframe of another light pattern, as the second keyframe.

14. A non-transitory computer-readable medium comprising computer-readable instructions, which, when executed by a processor of a device, cause the processor to:

obtain a plurality of keyframes, including a first keyframe and a second keyframe, wherein each keyframe is associated with a set of color palettes, and wherein each color palette is indicative of red-green-blue (RGB) illumination values of a light emitting diode (LED) from a plurality of LEDs, the first keyframe indicative of first RGB illumination values of each LED and the second keyframe indicative of second RGB illumination values of each LED;

retrieve the set of color palettes associated with each of the plurality of keyframes;

obtain a plurality of interpolated frames, at run-time, in between the first keyframe and the second keyframe;

calculate interpolated RGB illumination values for each interpolated frame in between the two keyframes, by, for each LED:

dividing a difference between each second RGB illumination value of the second keyframe and a corresponding first RGB illumination value of the first keyframe by a number of the interpolated frames to determine an incrementation value;

determining each interpolated RGB illumination value of each interpolated frame by successively incrementing between the corresponding first RGB illumination value of the first keyframe and a corresponding second RGB illumination value of the second keyframe by the incrementation value; and illuminate the plurality of LEDs, based on the RGB illumination values of the plurality of keyframes and interpolated RGB illumination values of the plurality of interpolated frames, to create a moving light pattern.

15. The non-transitory computer-readable medium as claimed in claim 14, wherein the instructions which, when executed by the processor, cause the processor to select a pre-defined current to be applied to each LED corresponding to the RGB illumination values of the plurality of keyframes and the interpolated RGB illumination values of the plurality of interpolated frames, to illuminate the plurality of LEDs.

16. The non-transitory computer-readable medium as claimed in claim 14, wherein the instructions which, when executed by the processor, cause the processor to perform a linear interpolation between a first keyframe and a last keyframe of the moving light pattern, as the first keyframe and the second keyframe, respectively, or between a keyframe of the moving light pattern and a keyframe of another light pattern, as the first keyframe and the second keyframe, respectively, to obtain the plurality of interpolated frames.

* * * * *